United States Patent [19]

Koch

[11] 3,948,296

[45] Apr. 6, 1976

[54] FRAME STAVE FOR HEALD FRAME OF WEAVING MACHINE

[75] Inventor: Bernhard R. Koch, Horgenberg, Switzerland

[73] Assignee: Grob & Co. Aktiengesellschaft, Horgen, Switzerland

[22] Filed: Jan. 20, 1975

[21] Appl. No.: 542,628

Related U.S. Application Data

[63] Continuation of Ser. No. 369,349, June 12, 1973, abandoned.

[30] Foreign Application Priority Data

June 30, 1972 Switzerland ..... 9872/72

[52] U.S. Cl. ..... 139/91

[51] Int. Cl.[2] ..... D03C 9/06

[58] Field of Search ..... 130/91, 92, 82, 1 R

[56] References Cited

UNITED STATES PATENTS

| | | | |
|---|---|---|---|
| 2,082,925 | 6/1937 | Watson et al. | 139/92 |
| 2,601,873 | 7/1952 | Kaufmann | 139/92 |
| 3,155,118 | 11/1964 | Kaufmann | 139/91 |
| 3,417,790 | 12/1968 | Pfarrwaller | 139/91 |
| 3,604,469 | 9/1971 | Kloten | 139/91 |
| 3,633,706 | 1/1972 | Kennedy | 139/1 R |

FOREIGN PATENTS OR APPLICATIONS

| | | | |
|---|---|---|---|
| 1,181,962 | 1/1959 | France | 139/92 |
| 6,911,347 | 1/1971 | Netherlands | 139/91 |
| 488,035 | 5/1970 | Switzerland | 139/91 |
| 2,018,050 | 5/1970 | France | 139/91 |
| 375,678 | 4/1964 | Switzerland | 139/92 |

*Primary Examiner*—James Kee Chi

*Attorney, Agent, or Firm*—Sughrue, Rothwell, Mion, Zinn & Macpeak

[57] ABSTRACT

A frame stave for a weaving machine heald frame is provided with an insert 4 or 6 to maintain the side walls 1, 2 under tension and thereby damp out resonant vibrations in the stave to reduce the operating noise level.

5 Claims, 8 Drawing Figures

FRAME STAVE FOR HEALD FRAME OF WEAVING MACHINE

This is a continuation of application Ser. No. 369,349, filed June 12, 1973, now abandoned.

BACKGROUND OF THE INVENTION

1. Field of the Invention

Heald frames for weaving machines mainly consist of two frame staves connected to each other by lateral supports to thus form a frame. The frame staves are generally made from hollow pieces such as steel tubes or other metal profiles. Such hollow profiles have the disadvantage of acting like a resonance board and transmit vibrations in form of sound into the air. It is known that considerable vibrations occur on the heald frames during the process of weaving resulting in the respective noise. This disturbing noise increases the faster the weaving machines are running. The problem in question therefore generally arises on modern, fast running weaving machines. Due to the increasingly stricter regulations concerning the allowable noise level in a weaving shed, a reduction of the noise level on all eaving machines is highly desirable.

2. Description of the Prior Art

It is known to fill the hollow frame staves with foamy plastic or the like, or to coat the profiles with sound-proofing material. This last proposal, however, is not practically feasible since the space available in a weaving machine does not permit coating the frame staves too thickly with layers of sound-proofing material to assure a considerable reduction of the noise. Also, the placing of filling material, lining of the hollow section, or coating the profiled stave with sound-proofing material does not provide the expected results.

SUMMARY OF THE INVENTION

This invention solves the problem of considerably reducing the noise level on fast running weaving machines in that both side walls of the hollow profiled frame stave facing each other are, under working conditions, kept under tension by way of pull or pressure.

DESCRIPTION OF THE PREFERRED EMBODIMENTS

To clarify the explanation only the parts of frame stave sections which are important for an understanding of the invention are illustrated. The deformations of the side walls are drawn in slightly exaggerated form.

FIGS. 1–4 show a cut of a hollow frame stave which is made of a light metal alloy. The side walls of the frame stave facing each other are designated 1, 2 and the enclosed hollow space is designated 3.

Figure 1:
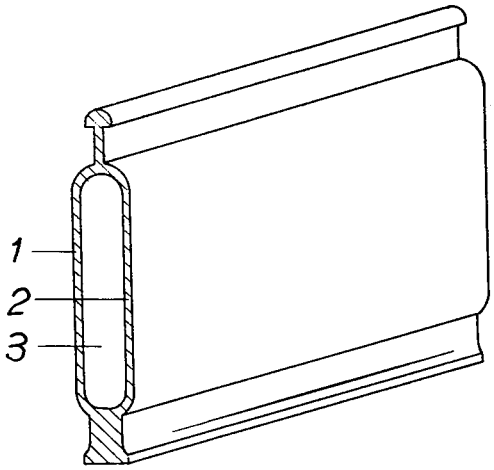
FIG. 1 is a perspective view of a section of a frame stave of the prior art with parallel side walls.
Figure 2:
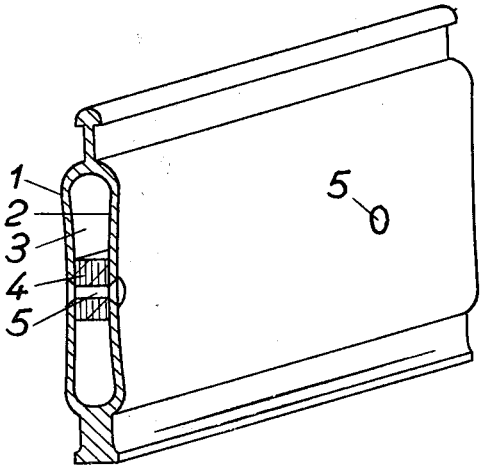
FIG. 2 shows the frame stave according to FIG. 1 whose side walls are being pulled towards each other in accordance with the invention.

The embodiment shown in FIGS. 1 and 2 is based on a conventional frame stave with parallel side walls 1, 2 as per FIG. 1. To put these side walls under tension according to the invention, the walls are pulled inwardly against an insert 4 by means of a pulling element 5, e.g. rivets, so that the walls — as exaggeratedly shown in FIG. 2 — will be arched to the inside.

Figure 3:
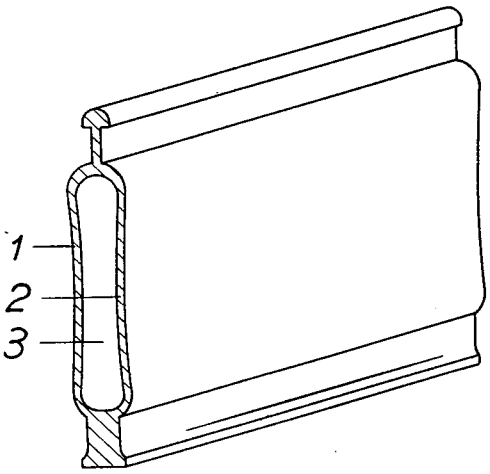
FIG. 3 is a section of a frame stave with side walls arched to the inside.
Figure 4:
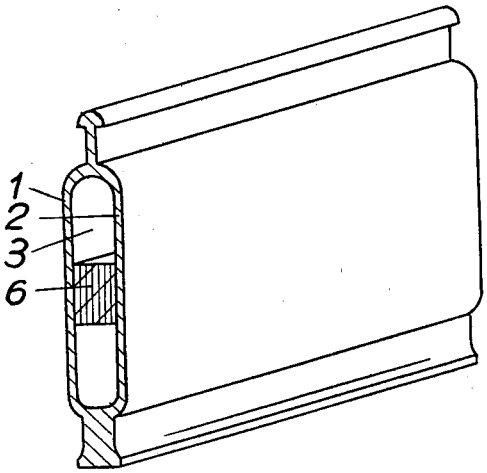
FIG. 4 shows the frame stave according to FIG. 3 in working condition with the side walls pressed apart from each other in accordance with the invention.

The embodiment according to FIGS. 3, 4 is based on a frame stave whose side walls facing each other are slightly arched to the inside (FIG. 3). By means of pressing-in a rod 6, which can be of a sound-proofing material, the side walls will be pressed to the outside causing the side walls to be parallel in the working condition.

In both of the embodiments the extent of the tension applied to the side walls of the hollow profile in the working condition will be determined by the width of the insert 4 or the rod 6 respectively.

FIGS. 5 to 8 show various ways to secure rod 6 in its position.

Figure 5:
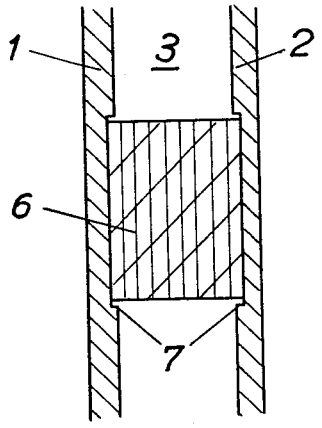
FIGS. 5–8 show detailed views of cross sections of frame staves having specific securing means in accordance with the invention.

In the alternative according to FIG. 5 the insides of the side walls 1,2 have longitudinal grooves 7 which partly surround the bar 6.

Figure 6:
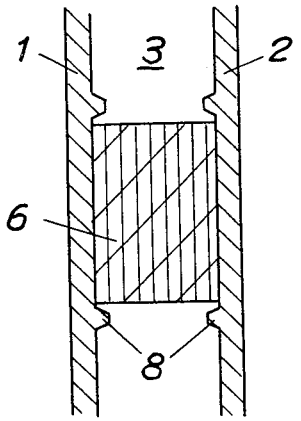

FIG. 6 shows side walls 1, 2 as having longitudinal ribs 8 holding the rod 6 in its position.

Figure 7:
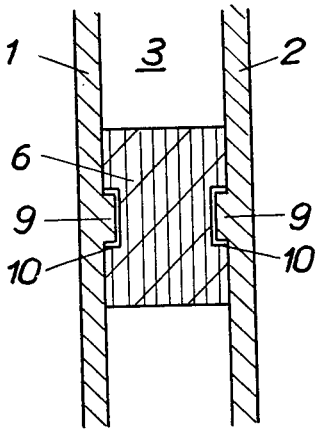

In the embodiment according to FIG. 7 the insides of the side walls 1,2 are provided with longitudinal ribs 9 fitting in longitudinal grooves 10 in the rod 6.

Figure 8:
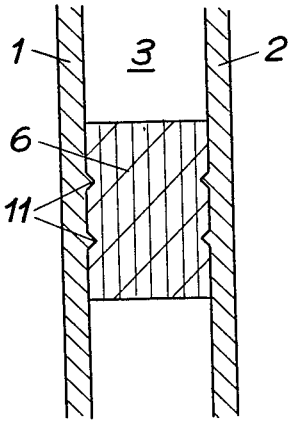

In FIG. 8 the side walls 1, 2 are provided with fine longitudinal ribs 11 which, due to the pressure of the initial tension, will be pressed into the softer material of the rod 6.

In all of the embodiments shown in FIGS. 5 to 8 it is, of course, possible that only one side wall or only one side of the rod 6, respectively, are provided with the securing means shown.

What is claimed is:

1. In a hollow metal frame stave for a weaving machine heald frame having two generally parallel sidewalls which define a hollow space therebetween, the improvement comprising insert means to place the sidewalls under tension, placed within and secured to said hollow frame stave substantially in the center thereof such that the height of said insert means extends over a portion of the height of the hollow space, and the insert means extends substantially along the entire length of said frame so as to minimize the generation of audible vibrations during operation of the weaving machine.

2. The improved frame stave of claim 1 wherein a. the width of said insert means is less than the distance between said sidewalls, and b. fastening means are inserted through said insert means and said sidewalls to bring said sidewalls into contact with said insert means.

3. The improved frame stave of claim 1 wherein the width of the insert means is greater than the distance between said sidewalls so as to slightly, outwardly deform said sidewalls when inserted therebetween.

4. A frame stave according to claim 1 wherein the insert means is kept in its position by means of grooves on at least the inner side of one of the side walls of the frame stave.

5. A frame stave according to claim 1 wherein the insert means is kept in its position by means of ribs on at least the inner side of one of the side walls of the frame stave.

* * * * *